US006669134B2

(12) United States Patent
Priest et al.

(10) Patent No.: US 6,669,134 B2
(45) Date of Patent: Dec. 30, 2003

(54) TAKE UP GUIDE TENSIONING SYSTEM

(75) Inventors: William L. Priest, Royal Oak, MI (US); Kevin Wright, Detroit, MI (US); Mark D. Nicholas, Waterford, MI (US)

(73) Assignee: Delphi Technologies, Inc., Troy, MI (US)

( * ) Notice: Subject to any disclaimer, the term of this patent is extended or adjusted under 35 U.S.C. 154(b) by 108 days.

(21) Appl. No.: 09/970,167

(22) Filed: Oct. 3, 2001

(65) Prior Publication Data

US 2003/0062439 A1 Apr. 3, 2003

(51) Int. Cl.[7] ..... B65H 75/38; B65H 75/44
(52) U.S. Cl. ..... 242/390.8; 242/407
(58) Field of Search ..... 242/602.1, 602.2, 242/603, 613.2, 613.3, 407, 390.8, 390.9, 587.1; 254/374; 49/332, 352; 74/505, 506

(56) References Cited

U.S. PATENT DOCUMENTS

| | | | | | |
|---|---|---|---|---|---|
| 1,403,021 | A | * | 1/1922 | Fogal | 242/602.1 |
| 3,212,727 | A | * | 10/1965 | Fonden et al. | 242/602.1 |
| 4,389,228 | A | * | 6/1983 | Leunig | 242/613.2 |
| 5,025,591 | A | * | 6/1991 | DeLand et al. | 254/374 |
| 5,335,883 | A | * | 8/1994 | Mawer | 242/602.1 |
| 6,282,839 | B1 | * | 9/2001 | Fischer et al. | 49/352 |

* cited by examiner

*Primary Examiner*—John M. Jillions
(74) *Attorney, Agent, or Firm*—Scott A. McBain

(57) ABSTRACT

An automatic sliding door cable mechanism with a take up guide member (46) mounted in a drum (14) for taking up slack of a cable during installation of the cable. A second drum (16) has an elliptical profile drum helix (96) for increasing durability of the operating cable for the automatic door.

12 Claims, 4 Drawing Sheets

TAKE UP GUIDE TENSIONING SYSTEM

TECHNICAL FIELD

This invention relates to a cable tension system and more particularly to a cable tension system for operating a power sliding vehicular door.

BACKGROUND OF THE INVENTION

Power sliding doors for automotive vehicles such as minivans have seen recent popularity. The use of automatic doors is a great convenience for handicapped people, for young children and for other people who have their hands filled for example with groceries.

The use of pull cables have been found to be an expeditious mechanism to both open the door and close the door. When the cable system is installed, the slack of the cable needs to be taken up for the cable system to operate. Thus, it is greatly desired to maximize the ease and speed in which the cable system is installed and tensioned.

SUMMARY OF THE INVENTION

In accordance with one embodiment of the invention, a take-up guide cable tensioning system has a first take-up drum having an outer surface for pulling on a cable assembly in a first direction, i.e. an opening direction for a power door. A second take-up drum has an outer surface for pulling the cable assembly in a second opposite direction, i.e. for closing the power door. The second drum rotates with the first take-up drum. The first drum has a slot under the outer surface. A take-up guide is slideably mounted in the slot and has spring loaded ratchet teeth normally mounted to engage complementary ratchet teeth in the slot to prevent movement of the take-up guide in one direction but allow movement in a second opposite direction. Preferably, the slot is arcuate and follows under the contour of the outer surface of the drum. In addition, it is desired that the ratchet teeth on the drum are progressively larger in the second opposite direction.

The take up guide has a section mounted to an end of a first cable of a cable assembly and when moved in the second opposite direction in the slot, takes up slack in the first cable between the first and second drum and provides tension in the cable assembly.

Preferably, the ratchet teeth are cantilevered and are resiliently movable to disengage from the complementary ratchet teeth in the arcuate slot to allow sliding movement of the take-up guide in the one direction to release the tension in said cable. It is also desired that the take-up guide has a slot therein to receive a tool that provides relative motion of the take up guide with respect to the drum having the slot in the second opposite direction.

In accordance with another aspect of the invention, a take-up guide cable tensioning system includes a housing having apertures therethrough for allowing passage of a cable therein and tool access therethrough. A spring loaded pulley is mounted in the housing for providing a spring-loaded tension on the cable. A tool is constructed to be passed into at least two of the apertures in the housing for rotating the first drum with respect to the take up guide and for limiting the compression of the spring loaded pulley. The first drum has gear teeth about its periphery to engage a small drive gear wheel. The tool is engageable to the small drum gear wheel to rotate the first drum with respect to the take up guide.

In accordance with another aspect of the invention, a take-up guide tension tool includes a handle operating end and an elongated shaft. The tool also has a socket end mounted at the end of said elongated shaft. A stop assembly is mounted about the shaft in proximity to the socket end and has a first stop member for engaging a spring-loaded pulley and a second stop member for retaining a take up guide tension assembly when the socket member rotates a drum member with respect to the take up guide. The shaft member is rotatable with respect to the stop assembly. Preferably, the handle has a lever that is connected to the shaft for driving the shaft in one selected direction and is rotatable through a ratchet connection about the shaft in a second opposite direction. It is also desired that a knob is affixed on a distal end of said shaft opposite the socket end.

In accordance with another aspect of the invention, a take-up guide cable tensioning system includes a take-up drum having an outer surface for pulling a cable in a first direction. The take-up drum has a slot under its outer surface. A take-up guide is slideably mounted in the slot and has at least one spring loaded ratchet tooth normally mounted to engage complementary ratchet teeth in the slot to prevent movement of the take-up guide in one direction. The take up guide having a section mounted to an end of the cable and movable in a second direction in said slot to take up slack in said cable and provide tension in said cable. At least one spring loaded ratchet tooth is cantilevered on said take up guide member and is resiliently movable to disengage from the complementary ratchet teeth in the slot to allow sliding movement of the take-up guide in the one direction to release the tension in the cable. Preferably, the take-up guide has a slot therein to receive a tool that provides rotatable motion of the take up guide with respect to the drum. The slot is preferably arcuate in shape that follows the contour of the outer surface of the first drum. The ratchet teeth on the drum are progressively larger in the second direction.

In this fashion, the cable between the first drum and door can be have its slack taken up and place the cable system into tension to provide optimal operation of the power door opening and closing apparatus.

BRIEF DESCRIPTION OF THE DRAWINGS

Reference now is made to the accompanying drawings in which.

DESCRIPTION OF THE PREFERRED EMBODIMENT

Figure 1:
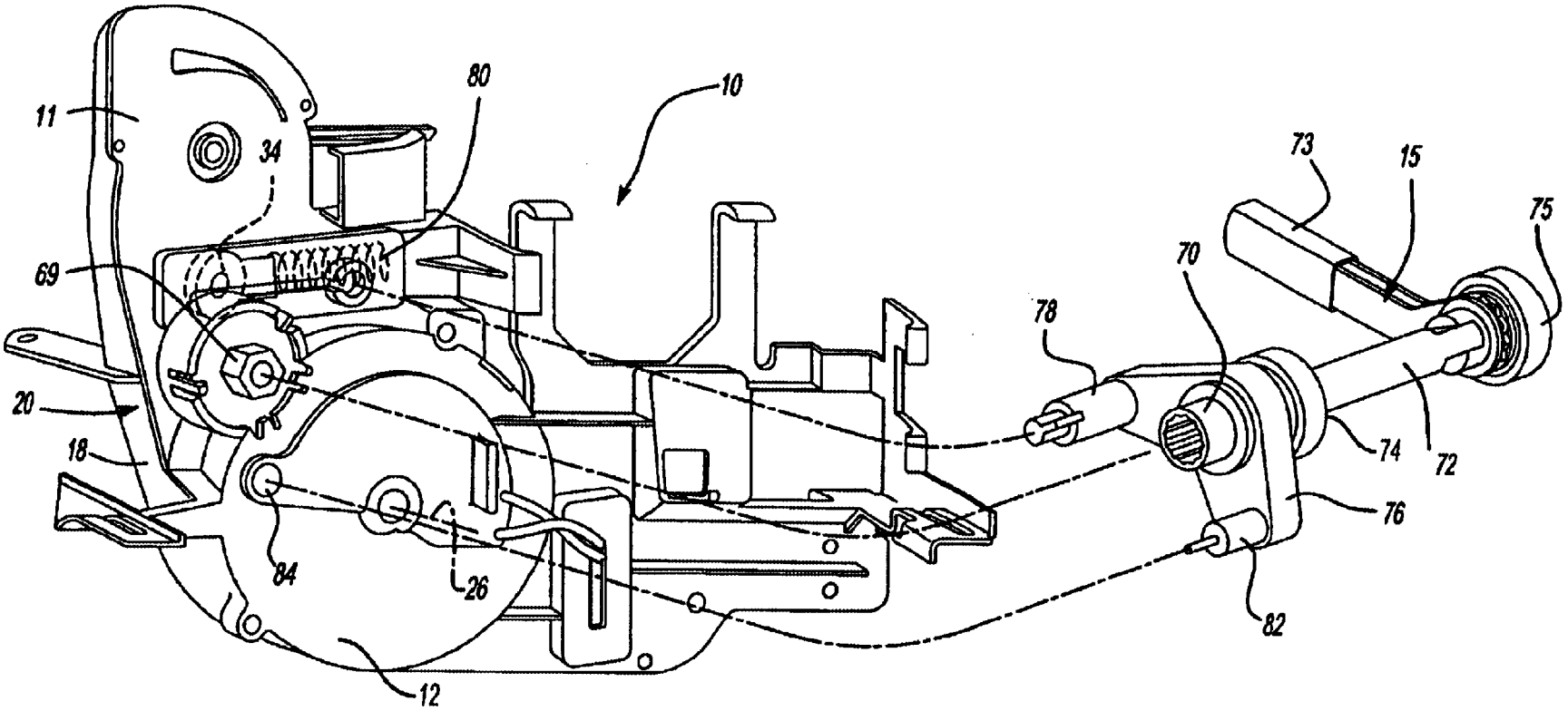
FIG. 1 is a perspective view of a cable drum assembly and a tool for installation.
Figure 2:
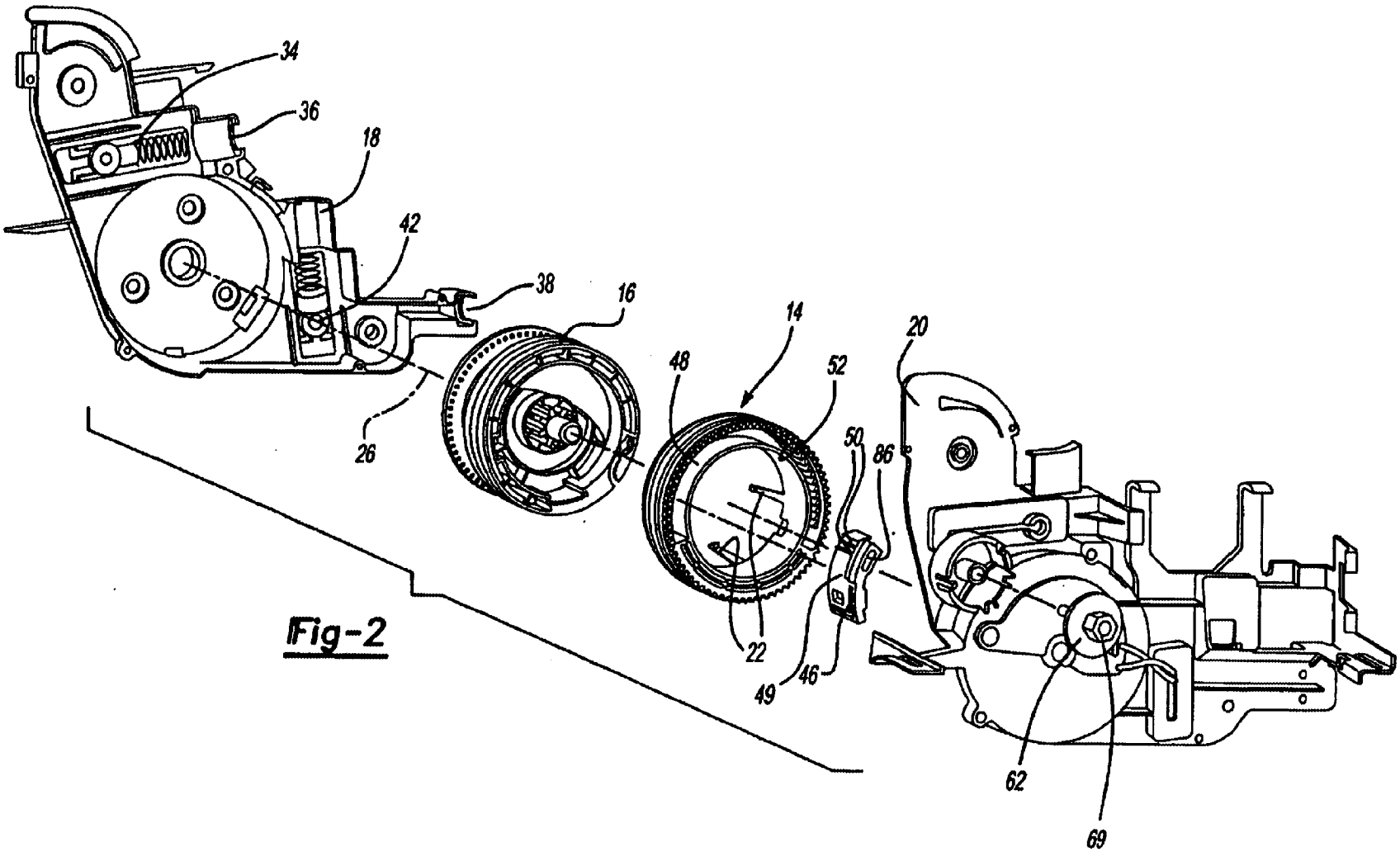
FIG. 2 is an exploded perspective view of the cable drum assembly shown in FIG. 1.

Referring now to FIGS. 1 and 2, a cable tension assembly 10 includes housing 11 is constructed to have a section 12 that rotatably houses a first drum 14 and second drum 16 that are connected to rotate together. A tool 15 can be operably mounted to the housing as shown in FIG. 1. The housing 11 has a body section 18 and cover 20 that are fitted together to retain the two drums within. The two drums snap fit together via prongs 22 fitting into apertures 24.

Both drums are rotatable via a motor not shown which rotates the drums about axis 26. The motor and controls for the motor are conventional and form no part of this invention.

Figure 5:
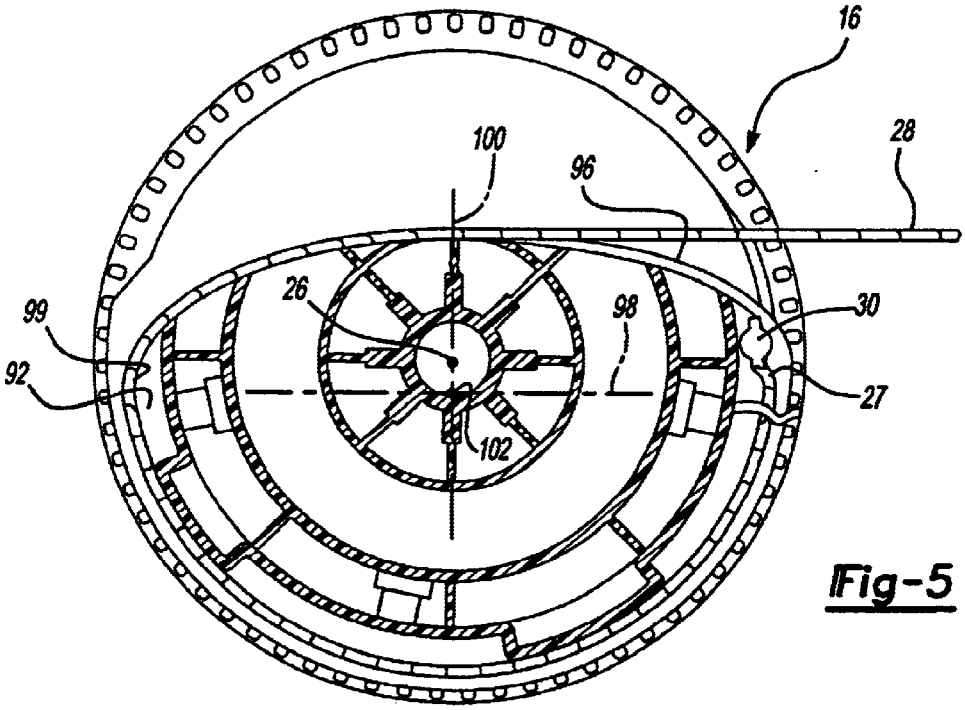
FIG. 5 is a partially segmented plan view of the drum 16 illustrating its elliptical contour section.

A cable 28 has one end secured 27 onto the second drum 16 at point 30 as shown in FIG. 5 and wraps about the outer surface 32 a plurality of times, extends about tension pulley 34 and out through an aperture 36 to exit the housing and be connected to the door (not shown).

Another cable 29 is then attached to the door and has its end 40 return back into the housing through aperture 38 and about a second tension pulley 42 and into the drum 14 through an aperture 44 in the drum. The end 40 then is connected to a tension take up member 46 that is mounted in an arcuate slot 48 within the drum 14. The take up member 46 has resiliently mounted ratchet teeth 50 on a cantilevered section 49 that normally engage complementary ratchet teeth 52 about the outer wall 54 of the slot 48. The cantilevered section 49 has some resilient flex.

Figure 3:
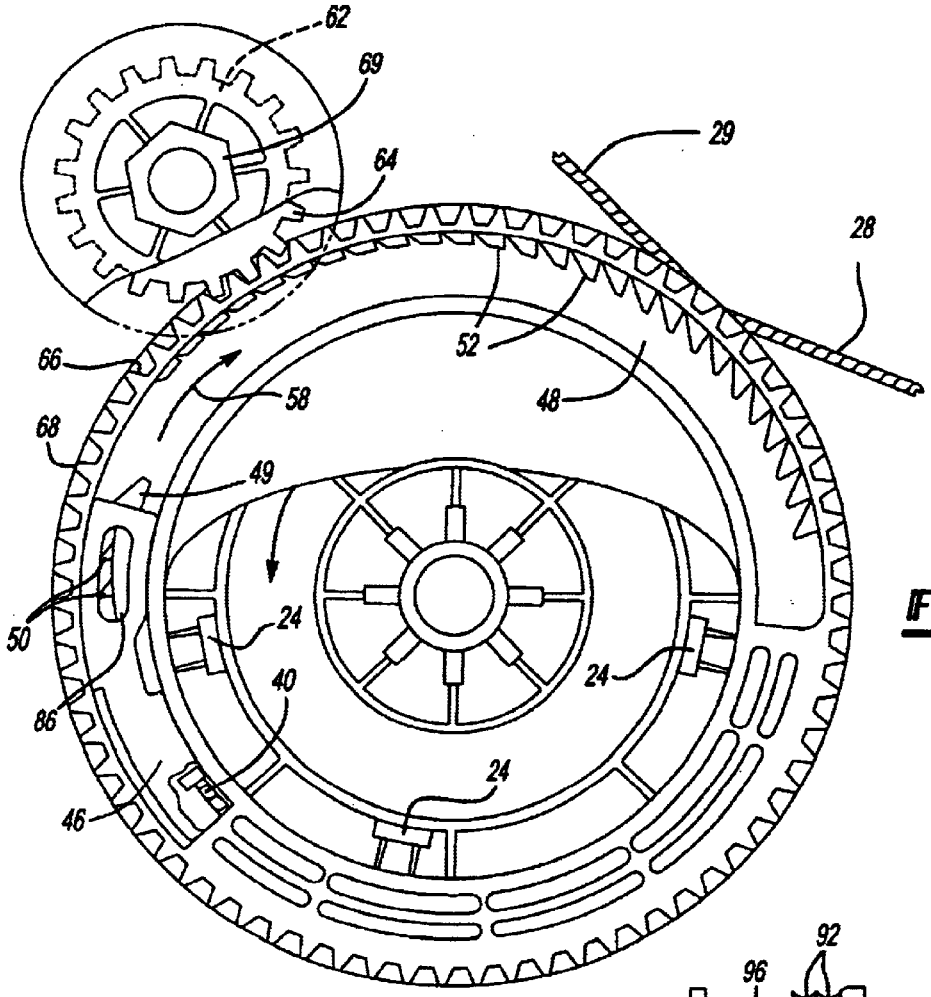
FIG. 3 is front plan view of the drums illustrating the take up guide member in its initial position.

The take up member is initially positioned in proximity to one end 56 of slot 48 as shown in phantom in FIG. 3. Furthermore there is sufficient length of cable 29 such that there is plenty of length of cable to easily reach end 40 of cable 29 into the slot 48 and be securely attached to tension take up member 46 without placing any tension onto cable 29.

The take up member is initially positioned in proximity to one end 56 of slot 48 as shown in phantom in FIG. 3. Furthermore there is sufficient length of cable 29 such that there is plenty of length of cable to easily reach end 40 of cable 29 into the slot 48 and be securely attached to tension take up member 46 without placing any tension onto cable 29.

A tool 15 and a gear wheel 62 expedite the take up of slack and the tensioning of the cable 28. The gear wheel 62 is rotatably mounted adjacent the drum 16 and has gear teeth 64 that engage teeth 66 about the perimeter 68 of drum 16. The gear wheel has an integral hex nut section 69 that can be engaged by tool 15. The tool 15 socket engaging section 70 is mounted on a distal end of a shaft 72 that is moved by a lever handle 73 that is connected through a ratchet connection 74. A knob 75 is also mounted on an opposing end of the shaft. A stop assembly 76 is rotatably mounted about the shaft and has one stop member 78 that protrudes through aperture 80 that limits the compression of the spring loaded pulley 34 to about one-half its travel capacity. Tool 15 also has a second stop member 82 that protrudes through aperture 84 and protrudes into slot 86 of take up guide member 46.

In operation, after the cable 28 has been attached to the door, the door is positioned so that the slot 86 is visible through the aperture 84. The installer then places tool 15 into position and cranks on lever handle 73 to rotate the shaft 72 which in turn rotates the nut 69 and gear wheel 62. The gear then rotates the drum 14 and drum 16. The tool simultaneously retains the take up member such that the take up member slides in slot 48 in the direction indicated by arrow 58 with the teeth 50 and 52 causing clicking indicating sounds. The excess cable is taken up onto the drum 16 as both drums rotate. Pulley 42 has its spring fully compressed and pulley 34 is limited by stop member 78. When the tool is disengaged the tension on both pulleys 42 and 54 re-balances to provide equal spring resiliency in both pulleys 34 and 42. The take up guide member remains positioned to be accessed through aperture 84 when the door is in the closed position.

If tension in the cable ever needs to be released, the drums 14 and 16 are positioned to align slot 86 with aperture 84. A screw driver is then placed into slot 86 to flex the cantilevered section to disengage the teeth 50 from teeth 52. Once the teeth are disengaged from each other the drums are free to rotate to release the tension of the cable system.

Drum 16 is used to pull cable 28 such that as the cable 28 wraps about its outer surface 90, the door is moved to its closed position. As the door is moved to its fully closed position, the driving motor must overcome the higher torque forces caused by sealing members and the closure latch in the last few centimeters of travel. The extra torque is provided by decreasing the effective outer radius of the drum 16 for the last few centimeters of travel.

Figure 6:
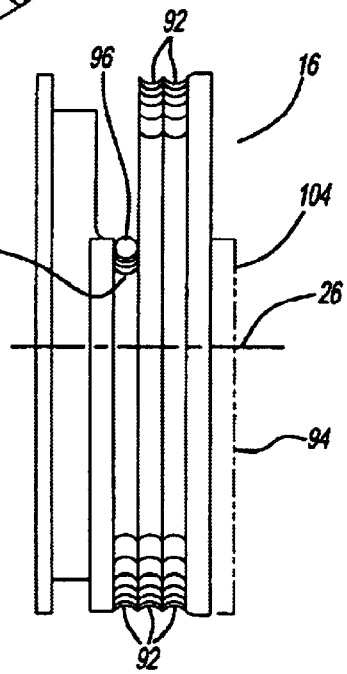
FIG. 6 is a side elevational view of the drum shown in FIG. 5.
Figure 4:
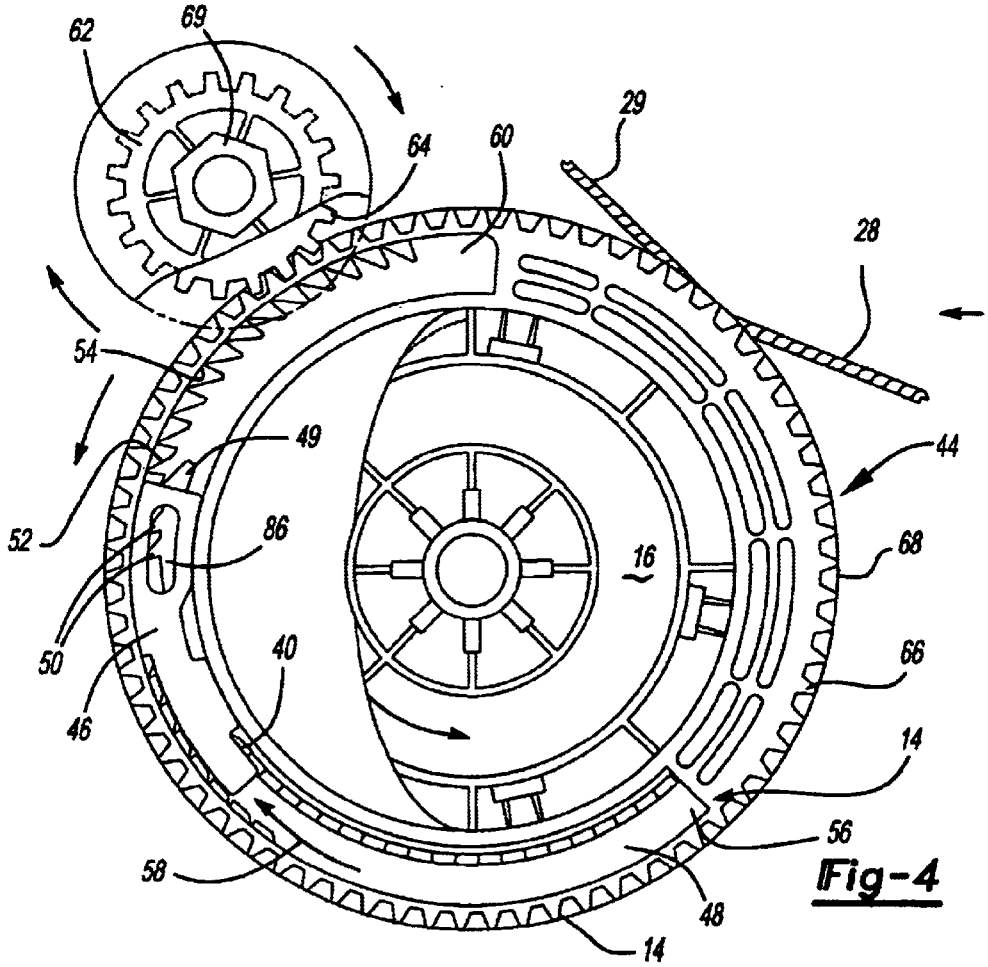
FIG. 4 is a view similar to FIG. 3 after the take up guide member has been moved to take up cable slack.

The drum 16 as more clearly shown in FIGS. 5 and 6 has a normal circular first outer surface section 92 normally referred to as a drum helix with a first radius indicated at 94. A second outer surface helix section 96 has an elliptical contour that is tangent to the first outer surface section 92 at point 99 in proximity to the major axis 98 of the contour. The minor axis 100 of the elliptical contour intersects the axis of rotation 26. The axis of rotation 26 is interposed between the defined center 102 of the elliptical contour and the elliptical contour surface 96. The elliptical contour is positioned such that the effective radius continually decreases from the tangent point 99 to the minor axis 100 to it's minimum radius indicated at 104.

It can be readily seen that the motor thus can provide for more torque to overcome the resisting forces of seals and latches by placing the cable along a smaller radius 104.

In this fashion, when the door is closed and the most tension is placed on the cable, the highest bending stresses occur near the tangent point 99 near the major axis 98 and the highest tensile forces are in proximity of the minor axis 100. However, the bending stress at the minor axis 100 is lowered due to its flattened elliptical contour. The most bending stress occurs along the major axis 98 where the tensile forces are lower. In this fashion, the location of the highest tensile force and the highest bending stress are displaced from each other along different sections of the cable 28. By displacing the location of these two highest forces from each other, one lowers the peak stress along any given point along the cable and thus provides for a more durable cable.

Variations and modifications are possible without departing from the scope and spirit of the present invention as defined by the appended claims.

We claim:

1. A take-up guide cable tensioning system comprising:

a first take-up drum having an outer surface for pulling a cable in a first direction;

a second take-up drum having an outer surface for pulling the cable in a second opposite direction;

said first and second drums operably connected to rotate together;

said first drum having a slot under the outer surface;

a take-up guide is slideably mounted in said slot and having spring loaded ratchet teeth normally mounted to engage complementary ratchet teeth in the slot to prevent movement of the take-up guide in one direction;

said take up guide having a section mounted to an end of the cable and movable in a second direction in said slot to take up slack in said cable and provide tension in said cable.

2. A take-up guide cable tensioning system as defined in claim 1 further comprising:

said ratchet teeth being cantilevered and being resiliently movable to disengage from said complementary ratchet teeth in said arcuate slot to allow sliding movement of said take-up guide in said one direction to release the tension in said cable.

3. A take-up guide cable tensioning system as defined in claim 2 further comprising:

said take-up guide having a slot therein to receive a tool that provides rotative motion of the take up guide with respect to the drum having the slot in the second direction.

4. A take-up guide cable tensioning system as defined in claim 3 further comprising:

said slot having an arcuate shape that follows the contour of the outer surface of the first drum;

said ratchet teeth on said drum being progressively larger in the second direction.

5. A take-up guide cable tensioning system comprising:

a housing having apertures therethrough for allowing passage of a cable therein and tool access therethrough;

a first take-up drum having an outer surface for drawing the cable in a first direction rotatably mounted in said housing;

a second take-up drum having an outer surface for drawing the cable in a second opposite direction rotatably mounted in said housing;

said first and second drums operably connected to rotate together;

a spring loaded pulley being mounted in a housing for providing a spring-loaded tension on said cable;

a tool constructed to be passed into at least two of said apertures in said housing for rotating said first drum with respect to a take up guide and for limiting the compression of said spring loaded pulley.

6. A take-up guide cable tensioning system as defined in claim 5 further comprising:

said first drum having gear teeth about its periphery;

a small drive gear wheel is engaged to said gear teeth of said first drum;

said tool engaging said small drum gear wheel to rotate said second drum with respect to said take up guide.

7. A take-up guide tensioning system as defined in claim 6 wherein said tool comprises:

a handle operating end and an elongated shaft;

a socket end mounted at the end of said elongated shaft;

a stop assembly mounted about said shaft in proximity to said socket end and having a first stop member for engaging a spring-loaded pulley and a second stop member for retaining a take up guide tension assembly when said socket member rotates a drum member with respect to said take up guide;

said shaft member being rotatable with respect to said stop assembly.

8. A take-up guide cable tensioning system as defined in claim 7 further comprising:

said handle having a lever that is connected to said shaft for driving said shaft in one selected direction and rotatable through a ratchet connection about said shaft in a second opposite direction and a knob affixed on a distal end of said shaft opposite said socket end.

9. A take-up guide cable tensioning system comprising:

a take-up drum having an outer surface for pulling a cable in a first direction;

said take-up drum having a slot under the outer surface;

a take-up guide is slideably mounted in said slot and having at least one spring loaded ratchet tooth normally mounted to engage complementary ratchet teeth in the slot to prevent movement of the take-up guide in one direction;

said take up guide having a section mounted to an end of the cable and movable in a second direction in said slot to take up slack in said cable and provide tension in said cable.

10. A take-up guide cable tensioning system as defined in claim 9 further comprising:

said at least one ratchet tooth being cantilevered and being resiliently movable to disengage from said complementary ratchet teeth in said slot to allow sliding movement of said take-up guide in said one direction to release the tension in said cable.

11. A take-up guide cable tensioning system as defined in claim 10 further comprising:

said take-up guide having a slot therein to receive a tool that provides rotative motion of the take up guide with respect to the drum having the slot in the second direction.

12. A take-up guide cable tensioning system as defined in claim 11 further comprising:

said slot having an arcuate shape that follows the contour of the outer surface of the first drum;

said ratchet teeth on said drum being progressively larger in the second direction.

* * * * *